US007503471B2

(12) United States Patent
Iwasaki

(10) Patent No.: US 7,503,471 B2
(45) Date of Patent: Mar. 17, 2009

(54) TABLET CUTTER

(76) Inventor: Azuma Iwasaki, 1017-33 Ooaza Kuroya, Iwatsuki-ku, Saitama-shi (JP) 339-0033

( * ) Notice: Subject to any disclaimer, the term of this patent is extended or adjusted under 35 U.S.C. 154(b) by 0 days.

(21) Appl. No.: 11/741,176

(22) Filed: Apr. 27, 2007

(65) Prior Publication Data

US 2007/0194074 A1 Aug. 23, 2007

Related U.S. Application Data

(63) Continuation of application No. PCT/JP2005/014859, filed on Aug. 8, 2005.

(51) Int. Cl.
*B26F 3/00* (2006.01)

(52) U.S. Cl. ..... 225/93; 225/103; 30/124

(58) Field of Classification Search ..... 225/103, 225/104, 93, 105; 30/120.2, 124, 185, 241; 206/528; 83/856

See application file for complete search history.

(56) References Cited

U.S. PATENT DOCUMENTS

| | | | | |
|---|---|---|---|---|
| 3,517,871 | A * | 6/1970 | Gaffney et al. | 225/103 |
| 4,422,553 | A * | 12/1983 | Hoeks et al. | 206/528 |
| 5,118,021 | A * | 6/1992 | Fiocchi | 225/103 |
| 5,944,243 | A * | 8/1999 | Weinstein | 225/93 |
| 6,474,525 | B1 * | 11/2002 | Reitano | 225/1 |
| 6,601,746 | B2 * | 8/2003 | Buckley et al. | 225/103 |
| 6,968,987 | B1 * | 11/2005 | Reitano | 225/1 |
| 7,275,671 | B1 * | 10/2007 | Reitano | 225/93 |
| 2006/0138190 | A1 * | 6/2006 | Williams | 225/103 |

FOREIGN PATENT DOCUMENTS

| | | |
|---|---|---|
| JP | 06-041546 A | 11/1994 |
| JP | 3071829 YA | 9/2000 |
| JP | 2001-238933 YA | 9/2001 |

* cited by examiner

*Primary Examiner*—Boyer D Ashley
*Assistant Examiner*—Omar Flores-Sánchez
(74) *Attorney, Agent, or Firm*—Lucas & Mercanti, LLP

(57) ABSTRACT

A tablet cutter is formed by a cutting edge mounted on the bottom of a hollow column in perpendicular thereto and a transparent top plate mounted on the top of the hollow column to close the top thereof, a convex edge fixing head and an edge bearing head on a concave side surface of the hollow column which conforms to the head so that the contacting area of the head and the edge bearing head to which impact is transferred upon cutting action. The width in a horizontal direction of the edge bearing head and the edge fixing head is larger than that of the edge bearing body and the edge fixing body, and these elements are covered with a cover having an inner diameter equal to the outer diameter of the hollow column.

2 Claims, 2 Drawing Sheets

TABLET CUTTER

This is a continuation of the International Application PCT/JP2005/014359, filed on Aug. 8, 2005, which in turn claims the priority benefit of the Japanese Patent Application No. 2004-344880, both priorities are claimed and both applications are incorporated herein by reference.

FIELD OF THE INVENTION

This invention relates to a tablet cutter.

BACKGROUND OF THE INVENTION

When dividing a tablet with a cutting line into halves, there have been employed scissors, knives, cutters or tablet cutters. When using such tools, the tablet is generally cut in such a manner that the cutting edge of the tool is applied to the cutting line of the tablet in the case of scissors, knives or cutters, while there are some conventional tablet cutters in which the tablet is cut in such a manner that the cutting line of the tablet is applied to the cutting edge of the tool. On the other hand, in the tablet cutter disclosed in Japanese Patent Application No. 2000-95836, the tablet is cut in such a manner that the cutting edge of the tool is applied to the cutting line of the tablet.

In the tablet cutters other than that disclosed in Japanese Patent Application No. 2000-95836, the position and/or the tablet is limited and since the tablet is cut in such a manner that the cutting line of the tablet is applied to the cutting edge of the tool, to apply the cutting line of the tablet is not easy and is troublesome, whereby the work is not efficient and shift is apt to be generated, when a tablet is divided.

Further, when scissors where a tablet is cut while grasping the tablet are used, the efficiency is low and the tablet can be dropped after the division since the work must be done grasping the tablet with the hand though the cut surface is clean.

Further, in the method of cutting a tablet disclosed in Japanese Patent Application No. 2000-95836, since cutting a tablet is done applying the cutting edge to the cutting line of the tablet, there is a fear that the tablet can jump out after dividing when the ceiling portion of the hollow column is opened and low and when the hollow column is of a hard and chemical-resistant resin such as acrylic resin and the cutting edge is fixed with its back in a direct contact with chemical-resistant resin such as acrylic resin, the hard and chemical-resistant resin can be cracked by the back of the cutting edge before about twenty pieces of tablets are cut due to impact during the cutting though cutting the tablet can be efficiently done and the tablet seldom scatters after dividing. Anyway, the method of fixing the cutting edge is not sufficiently described in Japanese Patent Application No. 2000-95836.

Accordingly, the object of the present invention is to provide an improved tablet cutter which is obtained by improving a tablet cutter disclosed in Japanese Patent Application No. 2000-95836 so that the tablet cannot jump out after dividing and crack is hard to be generated in the hollow column around the back of the cutting edge even if the hollow column is formed of a hard and chemical-resistant resin such as acrylic resin, and the cutting edge is hard to be shifted in the horizontal direction and the vertical direction.

SUMMARY OF THE INVENTION

A cutting edge (1) is mounted on the bottom of a hollow column (8) in perpendicular thereto and a transparent top plate (2) is mounted on the top of the hollow column (8) to close the top of the hollow column (8). With this arrangement, there is provided a tablet cutter where the inside of the hollow column (8) can be clearly viewed from above the hollow column (8) and the tablet cutter can be perfectly free from jumping out of the tablet after division irrespective of the height of the hollow column (8).

Further, when an edge fixing head (6) is a convex portion having a cylindrical curve in shape and an edge bearing head (4) on a side surface of the hollow column (8) is a concave portion and conforms to the edge fixing head (6) so that the contacting area of the edge fixing head (6) and the edge bearing head (4) to which impact is transferred upon cutting the tablet is increased, there is provided a tablet cutter where impact upon cutting the tablet is dispersed and concentrated impact upon cutting the tablet cannot be transferred to an edge bearing vertex (3*a*), whereby crack is hard to be generated in the hollow column around the back of the cutting edge even if the hollow column is formed of a hard and chemical-resistant resin such as acrylic resin.

When the size of the edge fixing head (6) is larger than the thickness and the width of an edge fixing body (7) and the edge fixing head (6) is fit in the edge bearing head (4) which is the same as the edge fixing head (6) in shape and an edge bearing body 5) which is the same as the edge fixing body (7) in shape, the movement of the cutting edge (1) in a vertical direction is limited and there is provided a tablet cutter where the cutting edge is less apt to move in a vertical direction. When the edge bearing head (4) of the hollow column (8), the edge fixing head (6), the edge bearing body (5) and the edge fixing body (7) are covered with a cover (9) having an inner circumference abutting an outer circumference of the hollow column (8), the movement of the cutting edge (1) in a horizontal direction is limited and there is provided a tablet cutter where the cutting edge is less apt to move in a horizontal direction.

PREFERRED EMBODIMENTS OF THE INVENTION

The present invention will be described in detail with reference to the drawings, hereinbelow.

Figure 3:
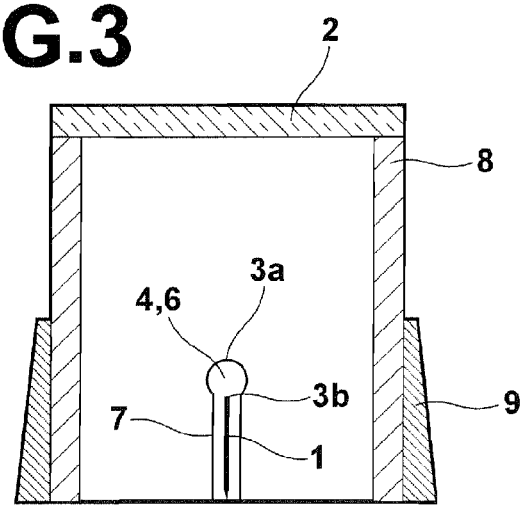
FIG. 3 is a cross-sectional view showing the central part of the cutting edge of a tablet cutter in accordance with a preferred embodiment of the present invention.
Figure 7:
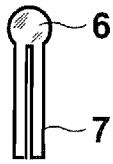
FIG. 7 is a front view of the component for fixing the cutting edge.

FIG. 3 shows a vertical cross-section of a tablet cutter in accordance with a preferred embodiment of the present invention. In FIG. 3, the cutting edge fixing part (4, 5 and 6) are shown for the purpose of simplicity. As material of a transparent top plate (2), synthetic resin high in transparency such as acrylic resin, glass or other materials high in transparency, and a magnifying lens formed by these materials can be used. As material of a hollow column (8) and a cover (9), a synthetic resin such as acrylic resin and metal such as aluminum can be used. As material of a cutting edge (1) and the component for fixing the cutting edge shown in FIG. 7, metal having a corrosion-proofness such as stainless steel, a synthetic resin high in hardness such as hard plastics, a ceramics high in hardness, and other hard material can be used.

In this tablet cutter, a cutting edge (1) is mounted on the bottom of a hollow column (8) in perpendicular thereto, a transparent top plate (2) is mounted on the top of the hollow column (8) to close the top of the hollow column (8), an edge fixing head (6) is a convex portion having a cylindrical curve in shape and an edge bearing head (4) on a side surface of the hollow column (8) is a concave portion and conforms to the edge fixing head (6) so that the contacting area of the edge fixing head (6) and the edge bearing head (4) to which impact is transferred upon cutting the tablet is increased, the size of the edge fixing head (6) is larger than the thickness of the width of an edge fixing body (7), the edge fixing head (6) is fit in the edge bearing head (4) which is the same as the edge fixing head (6) in shape and an edge bearing body (5) which is the same as the edge fixing body (7) in shape, and the edge bearing head (4) of the hollow column (8), the edge fixing head (6), the edge bearing body (5) and the edge fixing body (7) are covered with a cover (9) having an inner circumference abutting an outer circumference of the hollow column (8).

Figure 1:
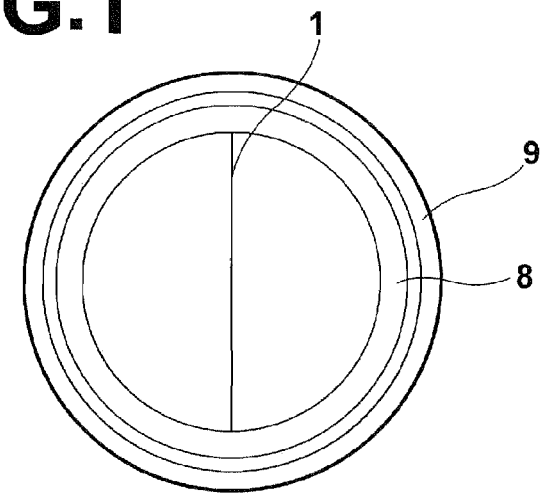
FIG. 1 is a plan view of FIG. 3.
Figure 2:
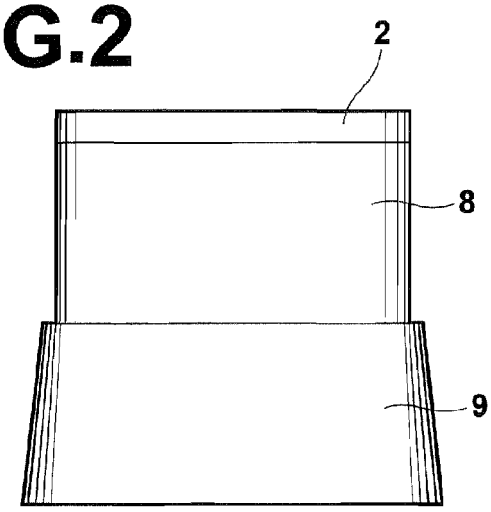
FIG. 2 is a front view of FIG. 3.
Figure 4:
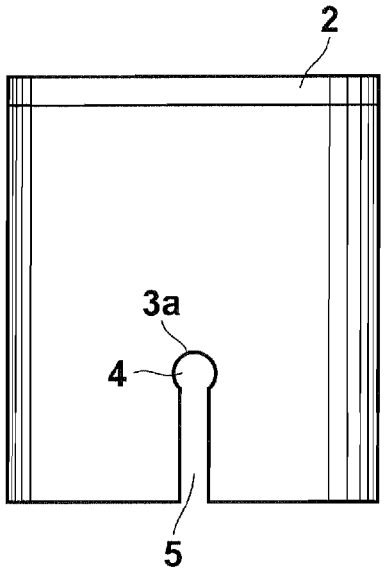
FIG. 4 is a front view of FIG. 3 with the cutting edge and the cover removed.
Figure 5:
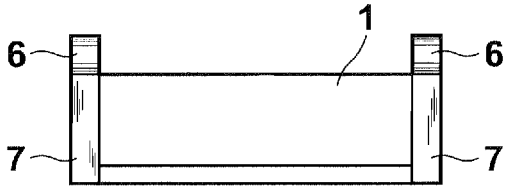
FIG. 5 is a front view of the cutting edge.
Figure 6:
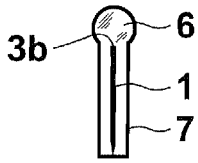
FIG. 6 is a side view of the cutting edge.

FIGS. 5 and 6 respectively show a front and side of a cutting edge and a component for fixing the same. A fixing component shown in FIG. 7 into which the edge fixing head (6) and the edge fixing body (7) are integrated is mounted on each of the opposite ends of the cutting edge (1). A preferred tablet cutter of this embodiment where the edge bearing head (4) and the edge bearing body (5) shown in FIG. 4 are mounted with this and covered with a cover (9) is shown in FIG. 2 in a front view and is shown in FIG. 1 in a view as seen from above.

When a tablet is to be divided by the preferred tablet cutter of this embodiment, a tablet with a cutting line is first put on a flat place and the cutting edge (1) is aligned with the cutting line of the tablet viewing the inside of the hollow column (8) from thereabove. Then when the cutting edge (1) is vertically depressed, the tablet is cut into halves. Further, by the use of a tablet cutting table (Japanese Patent Application No. 2004-300734), the tablet can be more cleanly cut and the tablets before cut can be separated from those after cut. Accordingly, when the preferred tablet cutter of this embodiment is employed together with the tablet cutting table (Japanese Patent Application No. 2004-300734), the cutting of the tablet can be effected in sequence smoothly and efficiently.

EMPLOYABILITY IN FIELD OF INDUSTRY

As described above, the tablet cutter of the present invention is useful when dividing a tablet in preparation of medicines, home and attending facilities. Further, when employed together with the tablet cutting table (Japanese Patent Application No. 2004-300734), its usefulness is more increased.

The invention claimed is:

1. A tablet cutter comprising a cutting edge mounted on the bottom of a hollow column in perpendicular thereto and a transparent top plate mounted on the top of the hollow column wherein an edge fixing head is a convex portion having a curve in shape and an edge bearing head on a side surface of the hollow column is a concave portion and conforms to the edge fixing head.

2. A tablet cutter as defined in claim 1 in which the size of the edge fixing head is larger than the thickness of the width of an edge fixing body and the edge fixing head is fit in the edge bearing head which is the same as the edge fixing head in shape and an edge bearing body which is the same as the edge fixing body in shape, and the edge bearing head of the hollow column, the edge fixing head, the edge bearing body and the edge fixing body are covered with a cover having an inner circumference abutting an outer circumference of the hollow column.

* * * * *